US007306385B2

(12) United States Patent
Takami et al.

(10) Patent No.: US 7,306,385 B2
(45) Date of Patent: Dec. 11, 2007

(54) LABEL PRINTING CONTROL METHOD AND LABEL PRINTER

(75) Inventors: Toru Takami, Shiojiri (JP); Go Hiroike, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 137 days.

(21) Appl. No.: 11/246,944

(22) Filed: Oct. 7, 2005

(65) Prior Publication Data

US 2006/0171754 A1 Aug. 3, 2006

(30) Foreign Application Priority Data

Feb. 1, 2005 (JP) ..... 2005-024987

(51) Int. Cl.
*B41J 11/44* (2006.01)

(52) U.S. Cl. ..... 400/76; 400/88

(58) Field of Classification Search ..... 400/76, 400/88, 613, 691, 693
See application file for complete search history.

(56) References Cited

U.S. PATENT DOCUMENTS 5,344,248 A * 9/1994 Schoon et al. ..... 400/693
6,988,309 B2 * 1/2006 Fore ..... 29/714
2005/0121146 A1 * 6/2005 Leonard et al. ..... 156/350

FOREIGN PATENT DOCUMENTS

| | | |
|---|---|---|
| JP | 04-272876 | 9/1992 |
| JP | 07-306974 | 11/1995 |
| JP | 2002128039 A * | 5/2002 |

* cited by examiner

*Primary Examiner*—Minh Chau
(74) *Attorney, Agent, or Firm*—Mark P. Watson

(57) ABSTRACT

A label printer can continue to print labels without causing a paper jam even when the label detector is not operating. During label printing by the label printer 1, this method confirms if the label detection operation of the optical sensor 14 disposed near the label dispensing slot 3 is normal or not (step ST2). If normal, the next label printing operation starts automatically after a label is printed and the optical sensor 14 detects that the label has been removed from the label dispensing slot 3 (steps ST3, 4, 5). If not normal, an error indicating LED flashes to inform the operator and operation switches to a manual label printing mode in which the optical sensor 14 is not used and starting the next label printing operation waits for manual input (steps ST6, 7, 8). Labels can still be printed when the optical sensor 14 is not operating normally.

9 Claims, 4 Drawing Sheets

LABEL PRINTING CONTROL METHOD AND LABEL PRINTER

TECHNICAL FIELD

The present invention relates to a label printer having an optical sensor or other type of label detector for detecting whether a printed label has been removed from the label dispensing slot, and relates more particularly to a label printing control method and label printer that can continue printing labels even when label detection by the label detector is not functioning.

BACKGROUND ART

A label printer generally prints labels while conveying label paper, which has labels adhesively affixed at a constant interval on a long web, passed the printing position, then peels the labels from the web by means of a peeler mechanism, and dispenses the printed peeled labels from a label dispensing slot. The peeler conveys the label paper around a bend of more than 90 degrees, and uses the stiffness of the label (the rigidity of the label paper) to peel each label from the web. Patent Reference 1 noted below teaches a printer having this type of peeler mechanism.

In this type of label printer the labels are conveyed to the label dispensing slot as the labels are peeled from the web by the peeler, and the web from which the labels have been peeled is discharged through a different path than the labels. Conveying the labels and web stops at the point where only a part of the trailing end of the label in the transportation direction remains affixed to the web. This is because the label will fall out if the printed label is completely separated from the web. Most of the label peeled from the web is exposed externally to the label dispensing slot at this point so that the operator can remove the label. At some point thereafter, the operator removes the printed label.

If the operator does not remove the printed label and the next label is printed and discharged while a label remains in the label dispensing slot, labels with the adhesive face exposed will build up one after another at the label dispensing slot, eventually leading to a paper jam. To avoid this, a reflective optical sensor is generally disposed as a label detector near the label dispensing slot to detect if the printed label remains in the label dispensing slot (that is, to detect the presence of a label). If the label detector detects that the label was removed (detects that a label is not present), the next label printing operation starts.

[Patent Reference 1] Japanese Patent No. 2992363

DISCLOSURE OF INVENTION

[Problem to be Solved by the Invention]

Using an optical sensor to detect whether a label has been removed from the label dispensing slot presents the problems described below.

When the task of printing and applying labels is conducted outdoors or indoors under bright lights, ambient external light incident to the optical sensor disposed near the label dispensing slot can result in labels not being correctly detected. If strong external light enters the receptor of the optical sensor, the output level of the optical sensor will not change regardless of whether or not a label is present, and label detection is thus rendered nonfunctional. In this situation the label detector always indicates that a label is present or always indicates that a label is not present.

If label printing continues after label detection becomes nonfunctional and the label detector always indicates that a label is not present, labels will be printed one after another, a paper jam will likely occur in the label dispensing slot, and subsequent label printing will have to be stopped.

On the other hand, if the label detector always indicates that a label is present, operation stops until the label detector indicates that a label is not present, and the next label printing operation thus stops.

Stopping the label printing operation is extremely inconvenient for the operator, and the same problem occurs when a switch or other non-optical type of sensor is used for the label detector if the detection operation of the label detector is not functioning normally.

Considering the foregoing, an object of the present invention is to provide a label printing control method and label printer that can print labels without causing a paper jam or cessation of the label printing operation even when the label detector for detecting whether or not a printed label remains in the label dispensing slot is rendered nonfunctional.

SUMMARY OF THE INVENTION

To resolve the foregoing problem, a label printing control method for a label printer according to the present invention executes a label detection operation using a label detector disposed near a label dispensing slot to detect if a printed label is or is not present at the label dispensing slot; enables the next label printing operation if a label is not present in the label dispensing slot; executes a confirmation operation to confirm if the label detection operation of the label detector is normal or not; and, if the label detection operation is not normal, disables label detector output and then waits for manual input to enable the next label printing operation.

If the label detection operation of the label detector is normal in this aspect of the invention, the next label printing operation is executed normally based on the output from the label detector. If an optical sensor is used as the label detector, the label printing operation based on output from the optical sensor is stopped if strong external light enters and renders label detection by the optical sensor nonfunctional. In this situation the next label printing operation is enabled when manual input is detected. If a problem with the label detector occurs, the operator can print another label by asserting this manual input after removing the label from the label dispensing slot, and printing the next label therefore does not become impossible. When the label detector returns to normal operation, label printing based on sensor output is once again enabled.

In the method of the invention confirming if the label detection operation of the label detector is normal or not can be done before the label detection operation (detecting if a label is present or not) during a label dispensing operation dispensing a label from the label dispensing slot. Because a label is dependably present in the label dispensing slot at this time, whether or not the label detector can detect a label (that is, whether the label detector is operating normally or not) can be reliably detected.

If an optical sensor is used as the label detector, for example, the light detected by the receptor will change synchronized to the flashing of the emitter if the emitter is driven to flash. If the receptor does not detect this change in light detection, the label detection operation of the optical sensor is known to be in error because of strong ambient light entering the receptor.

Further preferably, the confirmation operation in this method of the invention reports an error by means of an alarm unit when the label detection operation of the label detector is determined to be not normal. The operator can know from this report that the next label printing operation has switched to manual input.

The present invention also relates to a label printer for controlling label printing by means of the above method. A label printer according to the present invention comprises a peeler for separating printed labels from a long web; a label dispensing slot for discharging labels peeled from the web; a label detector for detecting whether or not a label remains in the label dispensing slot; an operation confirmation control unit for confirming whether or not the label detection operation of the label detector is normal; a manual operating member for manually starting a label printing operation; and a control unit for starting the next label printing operation based on output from the label detector if the label detection operation is normal, and disabling label detector output and then waiting for manual input to start the next label printing operation if the label detection operation is not normal.

Preferably, the operation confirmation control unit confirms if the label detection operation of the label detector is normal or not when a label is being discharged toward the label dispensing slot while being peeled from the web. At this time the printed label is positioned where the label can be reliably detected by the label detector. In addition, whether or not the label detector is operating normally, the control unit stops transportation of the label and web when a leading end portion of a label is discharged from the label dispensing slot and the trailing end portion of the label is still not separated from the web, and then waits for label removal from the label dispensing slot or for manual input.

Further preferably, the label printer also has an alarm unit for issuing an error report when the control unit determines that the detection operation of the label detector is not normal.

Yet further, a paper feed button such as commonly disposed to a label printer, for example, for feeding the labels and web by a manual operation can be used as the manual operating member.

[Effect of the Invention]

As described above, when the present invention detects that the label detector used for detecting if a label remains in the label dispensing slot is not operating normally, the invention waits for manual input to start the printing the next label. If the label detector is not operating normally, the next label is not printed when the operator removes the label from the label dispensing slot. When the next label is not printed after the label is removed, the operator can print the next label by means of manual input.

The present invention thus switches to a manual label printing operation when the label detector is functioning normally. Paper jams in the label dispensing slot caused by the next label printing operation starting even though a printed label remains in the label dispensing slot can therefore be prevented. Furthermore, because label printing can be continued manually, the operator will not be inconvenienced by unconditional interruption of the label printing process.

KEY TO THE FIGURES

Figure 1:
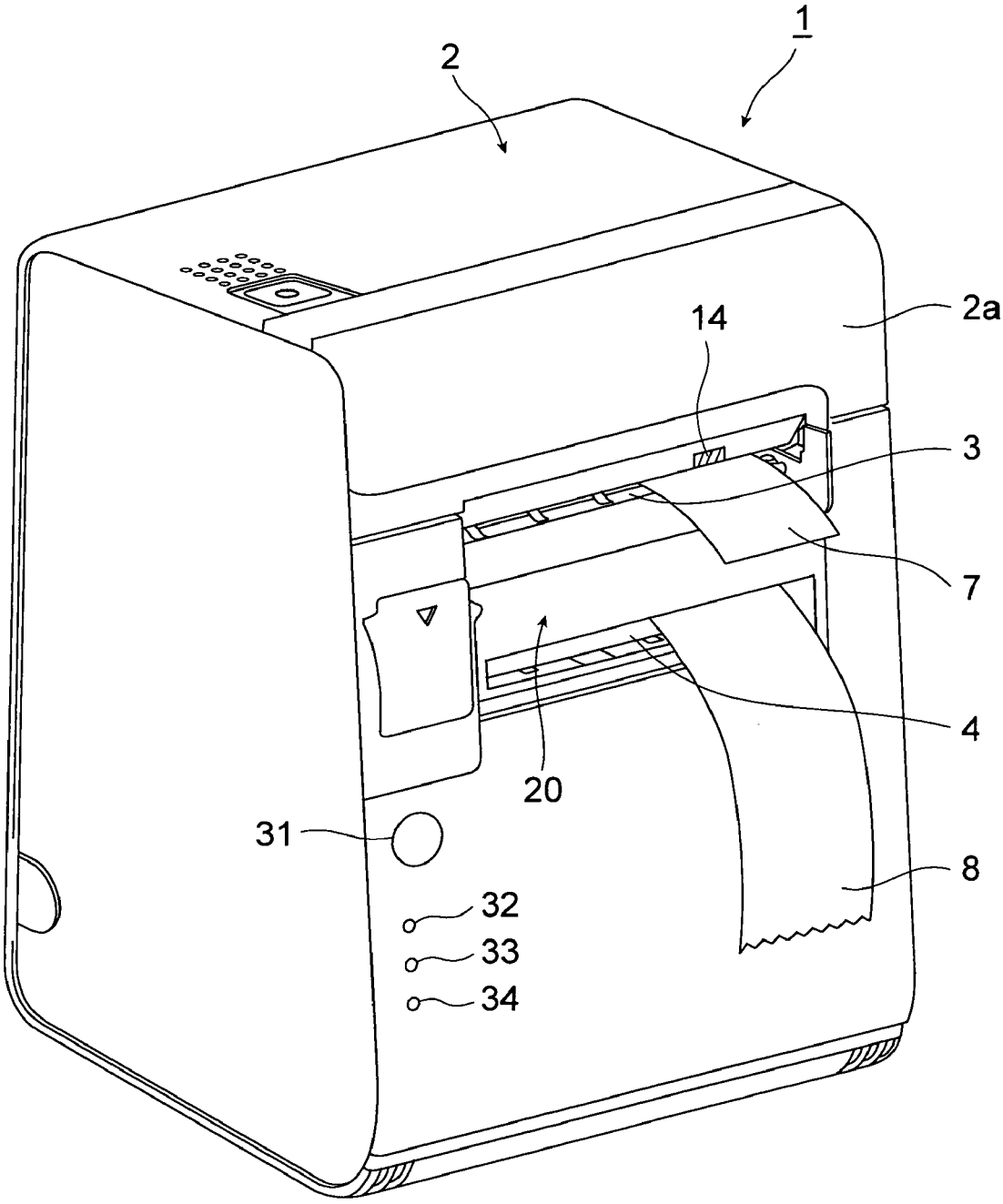
FIG. 1 is an oblique view of a label printer according to the present invention.

1 label printer
2 printer case
2*a* front panel
3 label dispensing slot
4 web discharge slot
5 roll paper compartment
6 roll paper
7 label
8 web
11 transportation path
12 thermal print head
13 platen roller
14 optical sensor
14*a* emitter
14*b* receptor
14S detection signal
20 peeler
21 web-bending guide
22 peeler roller
31 paper feed button
32 LED
40 host device
41 printer control circuit
42 operating unit

MODES FOR CARRYING OUT THE INVENTION

Preferred embodiments of a label printer according to the present invention are described below with reference to the accompanying figures.

Figure 2:
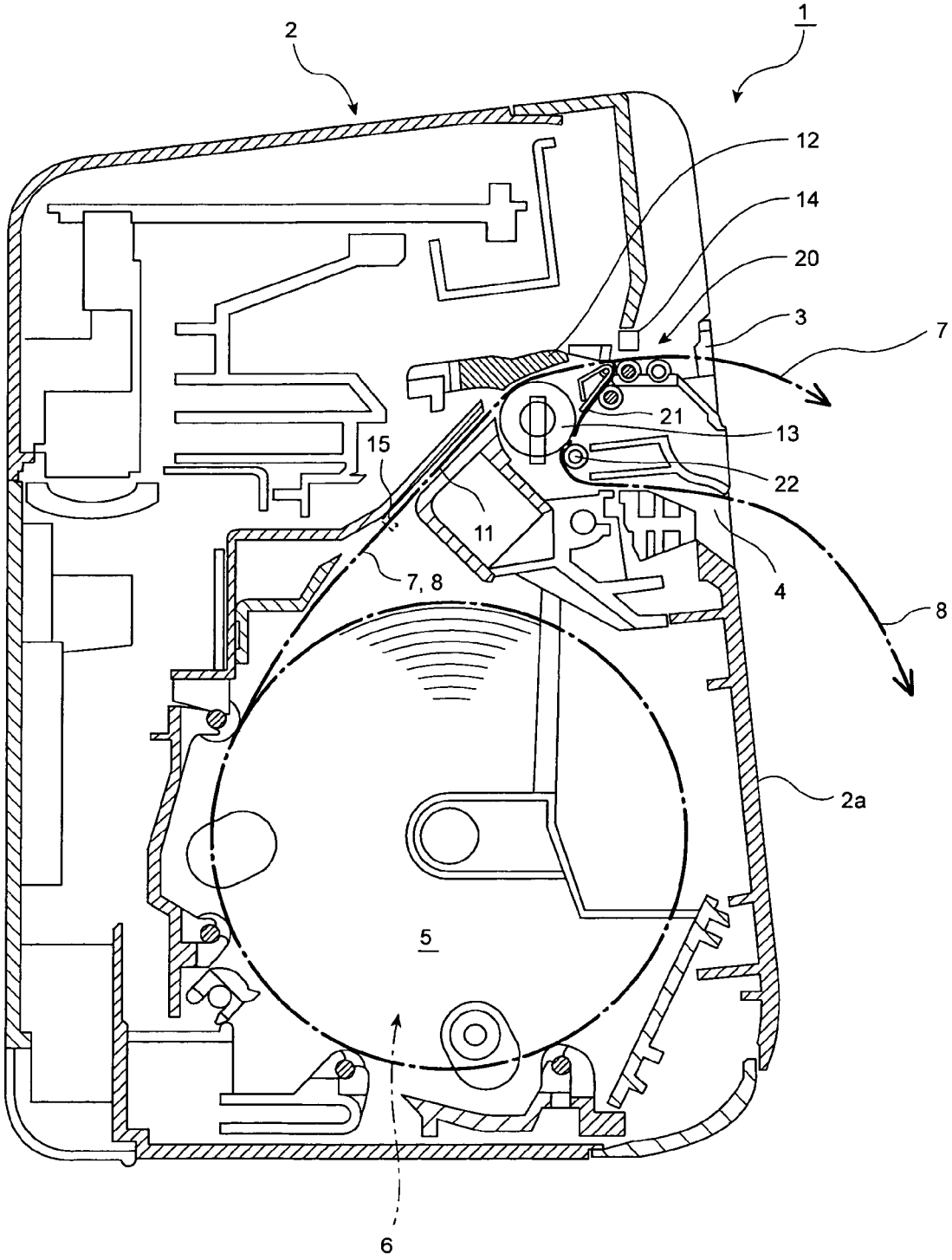
FIG. 2 is a section view of the label printer shown in FIG. 1.

FIG. 1 is an oblique view of a label printer according to the present invention, and FIG. 2 is a section view showing the internal arrangement of the label printer.

This label printer 1 has a printer case 2 with a tall box-like shape and a label dispensing slot 3 formed at the top of the front panel 2*a* and a web discharge slot 4 formed below the label dispensing slot 3. A paper feed button 31 and LEDs 32 to 34 for reporting the operating status are also disposed to the front panel 2*a*.

A roll paper compartment 5 is formed in the lower half inside the printer case 2. Roll paper 6, which is label paper wound into a roll, is loaded in the roll paper compartment 5. The roll paper 6 is composed of a long web 8 of a constant width having rectangular labels 7 adhesively affixed at a constant interval on the surface wound into a roll.

The web 8 with labels attached (label paper) delivered from the roll paper 6 loaded in the roll paper compartment 5 is guided through the transportation path 11 between the thermal print head 12 and platen roller 13. The platen roller 13 presses the paper to the printing surface of the thermal print head 12 and defines the printing position of the thermal print head 12. After a label 7 affixed to the surface of the web 8 is printed by the thermal print head 12, the web 8 is pulled from between the thermal print head 12 and platen roller 13 and conveyed passed the peeler 20, which has a web-bending guide 21 curving in an acute angle. The printed label 7 still affixed to the surface of the web 8 is separated from the web 8 by the peeler 20 and then dispensed from the label dispensing slot 3.

After the label 7 is peeled, the web 8 travels through an acute angle around the web-bending guide 21 and is conveyed through the transportation path. A peeler roller 22, which is part of the peeler 20 mechanism, applies pressure to the outside surface of the platen roller 13 at a position opposite the position where the platen roller 13 contacts the thermal print head 12. The web 8 curved in an acute angle by the web-bending guide 21 is held between and conveyed by the platen roller 13 and peeler roller 22, guided along the surface of the peeler roller 22 to the front of the printer, and discharged to the front of the printer from the web discharge slot 4.

A reflection type optical sensor 14 (label detector) for detecting labels 7 dispensed from the label dispensing slot 3 is disposed near the label dispensing slot 3. In addition, a transmission type optical sensor 15 that is used to control web 8 transportation is disposed on the downstream side of the thermal print head 12 on the transportation path 11 of the web 8 with intact labels to detect the position of labels 7 on the web 8 delivered from the roll paper 6. This enables knowing the position of the label 7 during transportation and thus enables printing to a desired position on the label 7 with the thermal print head 12.

Figure 3:
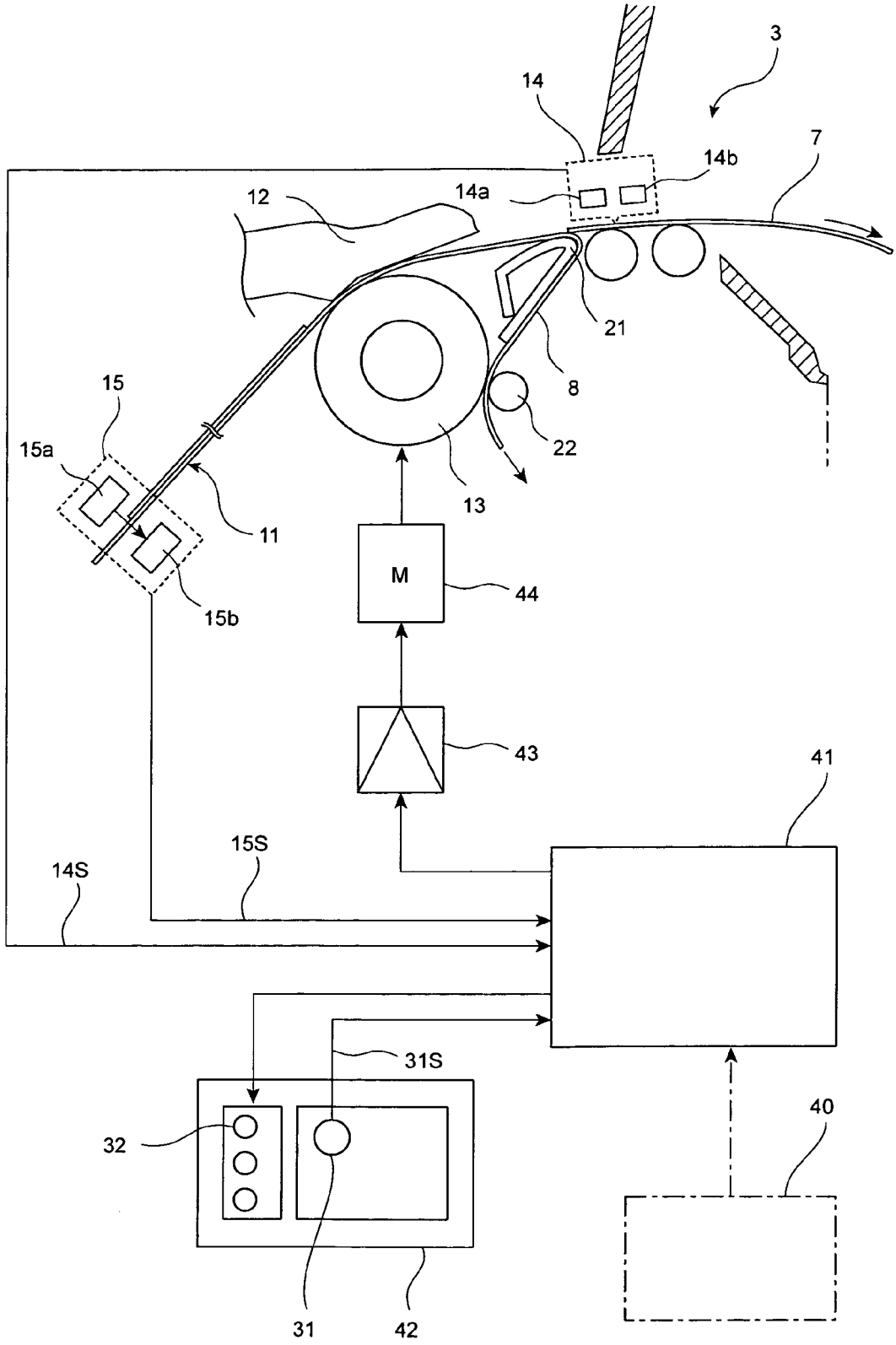
FIG. 3 is a schematic view of the control system of the label printer shown in FIG. 1.

FIG. 3 is a schematic diagram showing the main parts of the control system of this label printer 1. The printer control system is built around a CPU or other printer control circuit 41, and a computer or other host device 40 supplies control data and print data for label printing to the printer control circuit 41. When a print_label command is input from the host device 40 or operating unit 42, the printer control circuit 41 runs a label printing operation based on the detection signals 14S and 15S from optical sensors 14 and 15.

The reflection type optical sensor 14 disposed near the label dispensing slot 3 is composed of an emitter 14*a* and receptor 14*b* both rendered on the same side of the printed labels 7. When a label 7 is present, light from the emitter 14*a* is reflected by the label surface and incident to the receptor 14*b*, and the light detected by the receptor 14*b* thus increases. The presence of a label 7 can be detected based on this increase in received light.

The optical sensor 15 is a transmission type optical sensor and has an emitter 15*a* and receptor 15*b* in opposing positions on opposite sides of the transportation path of the web 8 with intact labels. When a label 7 on the web 8 passes between the emitter 15*a* and receptor 15*b*, the light from the emitter 15*a* is blocked because of the combined thickness of the label 7 and web 8, and the light detected by the receptor 15*b* thus drops or even goes to zero. When only the web 8 portion between the labels 7 passes, part of the light from the emitter 15*a* passes through the web 8 and the light received by the receptor 15*b* therefore increases. The printer control circuit 41 can confirm the position of a label on the web 8 with intact labels based on the detection signal 15S, which varies according to the change in light detection by the optical sensor 15.

While thus determining the position of the label 7, the printer control circuit 41 can control driving the paper feed motor 44 by means of intervening motor driver 43 to convey the web 8 with intact labels and print to a desired location on the label 7 by means of the thermal print head 12.

Furthermore, because the position of a label 7 can thus be known, the printer control circuit 41 can also know when a printed label 7 was conveyed to the near the label dispensing slot 3 and is in a position that can be detected by the optical sensor 14. Yet further, web transportation can be stopped when only a specific length of the trailing end of the printed label 7 remains affixed to the web 8 near the label dispensing slot 3.

When the label 7 is conveyed to a detectable position at the label dispensing slot 3 while being peeled by the peeler 20, the printer control circuit 41 drives the emitter 14*a* of the optical sensor 14 to flash at a regular period. Based on the detection signal 14S acquired from the receptor 14*b*, the printer control circuit 41 can confirm if the label detection operation of the optical sensor 14 is normal or not.

If the detection signal 14S changes in synchronization with the flashing period of the emitter 14*a* of the optical sensor 14, the optical sensor 14 can be determined to be operating normally without being affected by outside light. However, if the detection signal 14S does not change even though the emitter 14*a* of the optical sensor 14 is flashing, the optical sensor 14 can be determined to be affected by outside light and therefore unable to operate normally.

If the label detection operation of the optical sensor 14 is confirmed to be normal, the next label printing operation is executed based on the detection signal 14S from the optical sensor 14. If the label detection operation of the optical sensor 14 is confirmed not to be normal, the detection signal 14S of the optical sensor 14 is ignored and the next label printing operation waits for manual input.

This embodiment of the invention uses the paper feed button 31, which is operated to manually feed the web 8 with intact labels a desired distance, for this manual input. More specifically, if it is confirmed that the label detection operation of the optical sensor 14 is not normal, the printer control circuit 41 drives the error indicator LED 32 rendered in the operating unit 42 to flash to inform the operator that the optical sensor 14 is not operating normally. The label printing operation is then switched to a manual mode and the manual input signal 31S that is output when the paper feed button 31 is operated is used as the trigger signal for the next label printing operation.

Controlling the optical sensor 14 operation confirmation operation and label printing operation is achieved by running a control program previously stored in ROM in the printer control circuit 31.

Figure 4:
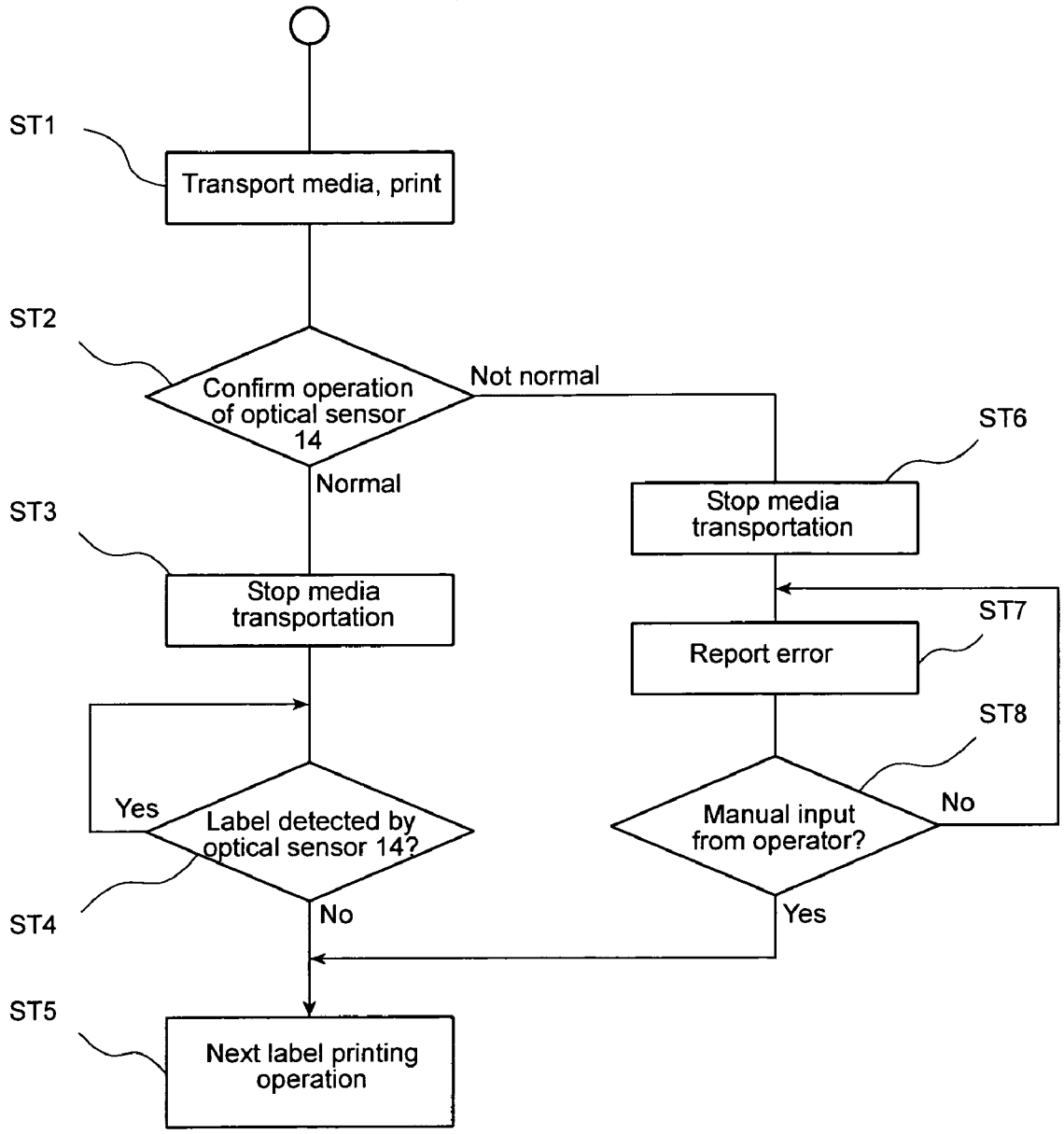
FIG. 4 is a schematic flow chart of the label printing operation of the label printer shown in FIG. 1.

FIG. 4 is a flow chart of the label printing operation of a label printer 1 according to this embodiment of the invention. This label printing operation is described below with reference to this flow chart.

When a print_label command is input from the operating unit 42 or host device 40, paper transportation starts after an indexing operation that positions the leading end of the first label 7 on the web 8 with intact labels to a specific position. The label 7 is then desirably printed synchronized to media transportation as the label 7 passes the printing position (step ST1).

The web 8 is then conveyed to the peeler 20 with the printed label 7 still affixed to the web 8. As the web 8 travels through the peeler 20, the label 7 gradually separates from the web 8 starting from the leading end of the label 7 and is conveyed toward the label dispensing slot 3. The optical sensor 14 is disposed to the transportation path from the peeler 20 to the label dispensing slot 3 (see FIG. 3). A sensor confirmation operation that determines if the label detection operation of the optical sensor 14 is normal or not executes during this label dispensing operation, which dispenses the label 7 from the label dispensing slot 3 while peeling the label 7 from the web 8 (step ST2).

During this sensor confirmation operation the emitter 14*a* of the optical sensor 14 is driven to flash repeatedly on a constant cycle. When optical sensor 14 operation is normal, light reception by the receptor 14*b* changes in a pulsing pattern synchronized to the flashing cycle of the emitter 14*a*. Operation is determined normal when a detection signal 14S representing this change in light detection is output.

If operation is determined to be normal, the label 7 peeled from the web is advanced to project a specific distance from the label dispensing slot 3, and the label dispensing operation is stopped with the trailing end of the label still affixed to the web 8 (step ST3).

The emitter 14*a* of the optical sensor 14 continues to be driven to flash repeatedly at a constant period, and whether the label 7 issued from the label dispensing unit 3 has been removed or not is determined based on the acquired detection signal 14S (step ST4).

If the label 7 remains, the light level detected by the receptor 14*b* changes in synchronization with the flashing of the emitter 14*a*, and the label 7 can be determined to still be present based on the detection signal 14S expressing this change in light level.

When the label 7 is removed, light detection by the receptor 14*b* stops changing in synchronization with the flashing of the emitter 14*a*, and the label 7 can be determined to have been removed based on the detection signal 14S expressing this state.

After confirming operation of the optical sensor 14 in step ST2, the emitter 14*a* can be driven to light steady instead of flashing for the label detection operation. Whether a label 7 is or is not present in the dispensing unit 3 can be determined based on the level of the detection signal 14S, which changes according to whether or not light emitted by the emitter 14*a* of the optical sensor 14 is reflected by the surface of the label 7 and enters the receptor 14*b*.

After the label 7 is removed (step ST4 returns No), operation waits for the next print_label command, and the next label printing operation starts automatically when the print command is received (step ST5). The next label printing operation does not start until the label 7 is removed (step ST4 returns Yes).

If the label detection operation of the optical sensor 14 is determined to not be normal, the label dispensing operation is stopped (step ST6), and the error indicator LED 32 on the operating unit 42 is driven to flash and report that an error occurred (step ST7).

If the label printer 1 is used outdoors, for example, and outside light is incident to the receptor 14*b* of the optical sensor 14, the light detected by the receptor 14*b* will remain at a constantly high level and will not change in synchronization with the emitter 14*a* of the optical sensor 14 even if the emitter 14*a* is flashing. This state is the same as the state after the label 7 has been removed, and label detection is thus not possible. As a result, if a detection signal 14S denoting this state is received, the label detection operation is determined to not be normal.

In this situation the label printing operation will not start automatically even after the label 7 is removed from the label dispensing slot 3. More specifically, the detection signal 14S of the optical sensor 14 is disabled and operation waits for the manual input signal 31S, which is asserted when the paper feed button 31 is pressed (step ST8 returns No). During this period the operator can remove the label 7 and press the paper feed button 31. When the manual input signal 31S is detected (step ST8 returns Yes), the next label printing operation starts (step ST5).

As described above, this embodiment of the invention changes from automatic to manual initiation of the next label printing operation when the detection operation of the optical sensor 14 that is used for label detection and is disposed near the label dispensing slot is not normal. More specifically, the next label printing operation does not start when the printed label 7 is removed from the label dispensing slot 3. The operator can know that a problem occurred from the report issued by the error indicator LED 32 flashing. Furthermore, the operator can also know that a problem occurred because the next label printing operation does not start when the label 7 is removed from the label dispensing slot 3. If the operator desires to print the next label in this situation, the operator can press the paper feed button 31 to trigger the next label printing operation and print one label.

It should be noted that the sensor confirmation operation for confirming if the label detection operation of the optical sensor 14 is normal or not is also executed when labels are printed manually. When the label detection operation returns to normal, the manual label printing operation is cancelled. That is, the error indicator LED stops flashing, whether the printed label 7 was removed from the label dispensing slot 3 is determined based on the detection signal 14S of the optical sensor 14, and the next label printing operation starts automatically when removal of the label is detected.

As described above, whether or not the label detection operation of the optical sensor 14 that detects if a label 7 remains in the label dispensing slot 3 is functioning normally or not is determined as part of every label printing operation in a label printer 1 according to the invention. If the detection operation is determined to be not normal, automatic initiation of the label printing operation based on output from the optical sensor 14 is cancelled and the label printing operation is changed to manual control.

If the optical sensor 14 is not operating normally due to interference from external ambient light, for example, problems such as paper jams occurring at the label dispensing slot 3 as a result of continuing to print labels 7 due to falsely detecting that the label 7 was removed can be prevented. At the same time, if printing a label 7 is desired when the optical sensor 14 is not functioning normally, the next label printing operation can be started by manual input. As a result, operation is also very user-friendly.

OTHER EMBODIMENTS

A reflection type optical sensor is used to detect if a label is present at the label dispensing slot in the foregoing embodiment of the invention. The invention can also be applied, however, to arrangements using a different type of label detector such as a transmission type photosensor or a switch.

An error indicating LED is used for reporting an error in the foregoing embodiment of the invention. A different type of alarm indicator for reporting an error to the operator, such as a liquid crystal display or buzzer, can also be used to the same effect, however.

The invention claimed is:

1. A label printing control method for a label printer, comprising:

a label detection operation for using a label detector disposed near a label dispensing slot to detect if a label is or is not present at the label dispensing slot;

a confirmation operation of confirming if the label detection operation of the label detector is normal or not; and disabling label detector output and then waiting for manual input to enable the next label printing operation if the label detection operation is not normal.

2. The label printing control method for a label printer according to claim 1, wherein:

the confirmation operation of confirming if the label detection operation of the label detector is normal or not is executed before a label dispensing operation for dispensing a label from the label dispensing slot.

3. The label printing control method for a label printer according to claim 2, wherein:

the confirmation operation reports an error by means of an alarm unit when the label detection operation of the label detector is determined to be not normal.

4. The label printing control method for a label printer according to claim 1, wherein an optical sensor is used as the label detector.

5. A label printer comprising:

a peeler for separating printed labels from a long web;

a label dispensing slot for discharging labels peeled from the web;

a label detector for detecting whether or not a label remains in the label dispensing slot;

an operation confirmation control unit for confirming whether or not the label detection operation of the label detector is normal;

a manual operating member for manually starting a label printing operation; and a control unit for starting the next label printing operation based on output from the label detector if the label detection operation is normal, and disabling label detector output and then waiting for manual input to start the next label printing operation if the label detection operation is not normal.

6. The label printer according to claim 5, wherein:

the control unit confirms if the label detection operation of the label detector is normal or not when a label is being discharged toward the label dispensing slot while being peeled from the web; and the control unit stops transportation of the label and web when a leading end portion of a label is discharged from the label dispensing slot and the trailing end portion of the label is still not separated from the web, and then waits for label removal from the label dispensing slot or for manual input.

7. The label printer according to claim 6, further comprising an alarm unit for issuing an error report when the control unit determines that the detection operation of the label detector is not normal.

8. The label printer according to claim 5, wherein the manual operating member is a paper feed button for feeding the labels and web by a manual operation.

9. The label printer according to claim 5, wherein the label detector is an optical sensor.

* * * * *